US008127374B2

(12) United States Patent
Willey et al.

(10) Patent No.: US 8,127,374 B2
(45) Date of Patent: Mar. 6, 2012

(54) SIDE POSITIONED VISION ENHANCEMENT DEVICE MOUNT

(75) Inventors: Charles D. Willey, Roanoke, VA (US); Gregory S. Bandy, Roanoke, VA (US); Kevin C. Schlirf, Winter Haven, FL (US)

(73) Assignee: Exelis, Inc., McLean, VA (US)

( * ) Notice: Subject to any disclaimer, the term of this patent is extended or adjusted under 35 U.S.C. 154(b) by 563 days.

(21) Appl. No.: 12/355,198

(22) Filed: Jan. 16, 2009

(65) Prior Publication Data

US 2010/0180364 A1 Jul. 22, 2010

(51) Int. Cl.
*A42B 1/24* (2006.01)

(52) U.S. Cl. ..... 2/422; 2/205

(58) Field of Classification Search ..... 2/422, 205.1, 2/6.7, 6.2, 410, 421; 345/8
See application file for complete search history.

(56) References Cited

U.S. PATENT DOCUMENTS

| | | | | |
|---|---|---|---|---|
| 4,577,347 | A | 3/1986 | Connon | |
| 4,850,690 | A * | 7/1989 | Parker et al. | 351/205 |
| 5,471,678 | A * | 12/1995 | Dor | 2/6.7 |
| 5,581,806 | A * | 12/1996 | Capdepuy et al. | 2/6.2 |
| 6,560,029 | B1 * | 5/2003 | Dobbie et al. | 359/631 |
| 6,957,449 | B2 * | 10/2005 | Prendergast | 2/422 |
| 7,193,783 | B2 * | 3/2007 | Willey et al. | 359/630 |
| 7,219,370 | B1 | 5/2007 | Teetzel | |
| 2003/0115662 | A1 * | 6/2003 | Dobbie et al. | 2/422 |
| 2004/0244099 | A1 * | 12/2004 | Prendergast | 2/422 |
| 2005/0035925 | A1 | 2/2005 | Ostromek et al. | |
| 2006/0007562 | A1 * | 1/2006 | Willey et al. | 359/811 |
| 2007/0012830 | A1 * | 1/2007 | Prendergast | 248/200 |
| 2007/0114252 | A1 | 5/2007 | Gruebel | |
| 2009/0135506 | A1 * | 5/2009 | Willey et al. | 359/815 |
| 2010/0083413 | A1 * | 4/2010 | McGovern | 2/6.6 |

OTHER PUBLICATIONS

European Search Report dated Oct. 7, 2011, in related European Patent Application No. 10150558.4.

* cited by examiner

*Primary Examiner* — Brian D Nash
(74) *Attorney, Agent, or Firm* — RatnerPrestia

(57) ABSTRACT

A device mount for mounting a vision enhancement device to an article worn on a user's head includes a first adjustment member operable to move a mounted vision enhancement device in a cranial-caudal direction with respect to the user. A second adjustment member which extends from the first adjustment member is operable to move a mounted vision enhancement device along a medial-lateral adjustment axis with respect to the user. A third adjustment member includes an extension arm extending from the second adjustment member that rotates with respect to the medial-lateral adjustment axis of the second adjustment member. A helmet apparatus includes a device mount and power supply that are offset from an anterior-posterior axis of the helmet in a counterbalancing arrangement.

17 Claims, 7 Drawing Sheets

SIDE POSITIONED VISION ENHANCEMENT DEVICE MOUNT

FIELD OF THE INVENTION

The present invention relates generally to head mounted equipment for vision enhancement and more specifically to a mounting assembly for mounting vision enhancement equipment to a helmet or other article worn on the head.

BACKGROUND OF THE INVENTION

Head or helmet mounts allow vision enhancement devices, such as direct view goggles or displays for cameras, to be mounted on the head or helmet in front of a user's eye. The user can view his or her surroundings through the vision enhancement device, while keeping his or her hands free to perform various tasks. Typical mounts are positioned on the helmet, head harness or other article so that the vision enhancement device is mounted centrally over the user's forehead. This central positioning results in a large overhanging structure that is relatively heavy, with a large forward projection. The storage position of the device is far above the user's head, creating a conspicuous profile that is a snag hazard and imposes additional strain on the user's neck. For these reasons, conventional head or helmet mounts for vision enhancement devices have significant drawbacks.

SUMMARY OF THE INVENTION

The drawbacks of conventional head or helmet mounts are resolved in many respects by device mounts of the present invention. In one aspect of the invention, a device mount for mounting a vision enhancement device to an article worn on a user's head includes a first adjustment member operable to move a mounted vision enhancement device in a cranial-caudal direction with respect to the user. A second adjustment member which extends from the first adjustment member is operable to move a mounted vision enhancement device along a medial-lateral adjustment axis with respect to the user. A third adjustment member includes an extension arm extending from the second adjustment member that rotates with respect to the medial-lateral adjustment axis of the second adjustment member.

In another aspect of the invention, a helmet apparatus includes a helmet body, a vision enhancement device, a device mount, and a power supply. The helmet body has an anterior end, a posterior end and an anterior-posterior axis. The vision enhancement device extends from the helmet body and is supported by the device mount. The device mount is attached to the anterior end of the helmet body in a position offset from the anterior-posterior axis of the helmet body. The power supply is positioned at the posterior end of the helmet body at a location offset from the anterior-posterior axis of the helmet body, generally opposite the location of the device mount.

BRIEF DESCRIPTION OF THE DRAWINGS

The foregoing summary and the following description of embodiments will be better understood when reviewed in conjunction with the drawing figures, of which.

DETAILED DESCRIPTION OF EMBODIMENTS OF THE INVENTION

Although the invention is illustrated and described herein with reference to specific embodiments, the invention is not intended to be limited to the details shown. Rather, various modifications may be made in the details within the scope and range of equivalents of the claims and without departing from the invention.

Figure 1:
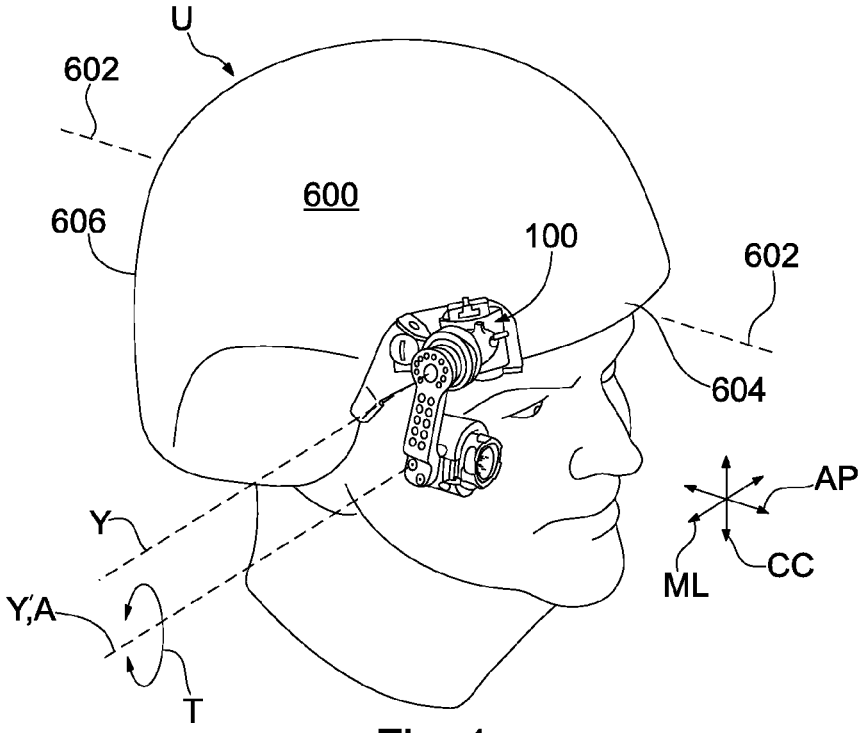
FIG. 1 is a perspective view of a helmet apparatus in accordance with one exemplary embodiment of the invention, schematically shown as it would appear in use.

Device mounts in accordance with the invention resolve a number of drawbacks observed with conventional mounting systems for vision enhancement devices. Referring to FIG. 1, a device mount 100 for mounting a vision enhancement device is shown on a helmet body 600 worn by a user U. Device mount 100 is mounted at a position that is offset to one side of helmet 600, i.e., to one side of an axis 602 that extends between an anterior end 604 and a posterior end 606 of helmet 600. A portion of device mount 100 is aligned with the user's interpupillary axis A, i.e. an axis extending through both of the user's pupils. In this arrangement, device mount 100 can mount a vision enhancement device in very close proximity to a user's eye, with the mount itself being positioned away from the front of the helmet.

Figure 2:
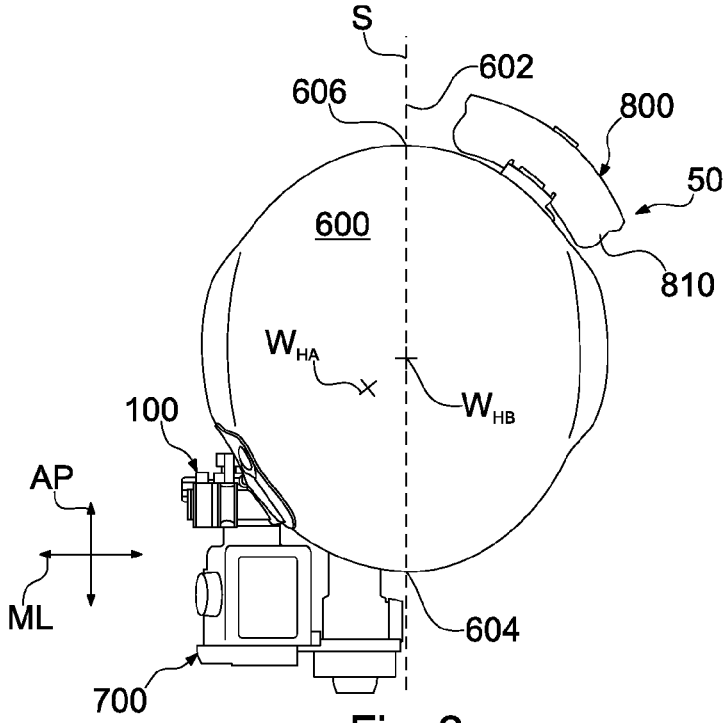
FIG. 2 is a top view of a helmet apparatus in accordance with one exemplary embodiment of the invention, shown with a vision enhancement device.

Referring to FIG. 2, a helmet assembly 50 is shown which includes device mount 100, helmet body 600, a vision enhancement device 700 and a power supply 800. Vision enhancement device 700 is connected to device mount 100, which in turn is mounted on helmet 600. Device mount 100 supports vision enhancement device 700 in a position that is offset from anterior-posterior axis 602. Power supply 800 includes a battery pack 810 that is laterally offset from posterior end 606 of helmet 600. In this arrangement, vision enhancement device 700 and battery pack 800 are positioned at generally opposite sections of helmet 600. The weight of power supply 800 counterbalances the weight of device mount 100 and vision enhancement device 700. Therefore, the center of mass of helmet assembly $W_{HA}$ is maintained in proximity to the center of mass of helmet body $W_{HB}$.

It will be understood that $W_{HA}$ and $W_{HB}$ need not be in the relative positions shown, and may instead be at the same position. Depending on user preference, $W_{HA}$ and $W_{HB}$ may both be adjusted to a central location where $W_{HB}$ is shown in FIG. 2.

The laterally offset mounting of the vision enhancement device provides a number of advantages over conventional mounting arrangements. Typically, the structural mass necessary to support a device mounted centrally at the front end of a helmet (i.e. above the user's forehead) creates a greater than necessary distance from the center of the user's head to the center of mass of the system. This imposes significant unnecessary strain on the user's neck. In addition, the storage position of the device is far above the user's head, creating a conspicuous profile that imposes strain on the user's neck, and creates a potential for the device to collide or become entangled with objects above the user's head. Mounting devices in accordance with the invention, like device mount 100, avoid these problems by mounting the vision enhancement device at a lower position to one side of the helmet body. One of the major points of adjustment on device mount 100 is located adjacent the user's preferred eye, rather than centrally above the eyes, as will be described in more detail below. This arrangement reduces the amount of structure needed to support the device, resulting in an overall reduction in mass and a decreased forward projection.

Referring now to FIGS. 1-4, device mount 100 includes four adjustment mechanisms that operate independently to adjust the relative position and orientation of the vision enhancement device with respect to the user's eye. Each adjustment mechanism has a separate range of motion. The directions of adjustment are referred to herein and for all purposes as: "anterior-posterior" (labeled AP), "medial-lateral" (labeled ML), "cranial-caudal" (labeled CC) and "tilt" (labeled T). Anterior-posterior adjustment moves the device forwardly and rearwardly with respect to the user's face, or front of the helmet, as the case may be, in a direction parallel to the user's sagittal plane S (shown contiguous with anterior-posterior axis 602 in FIG. 2). Medial-lateral adjustment moves the device toward and away from the user's sagittal plane S, i.e., perpendicularly to the anterior-posterior direction. Cranial-caudal adjustment moves the device up and down, perpendicularly to the anterior-posterior and medial-lateral directions. Finally, tilt adjustment changes the orientation and viewing angle of the device, allowing the user to adjust the line of sight upwardly or downwardly with respect to the user's view looking straight ahead.

Figure 5:
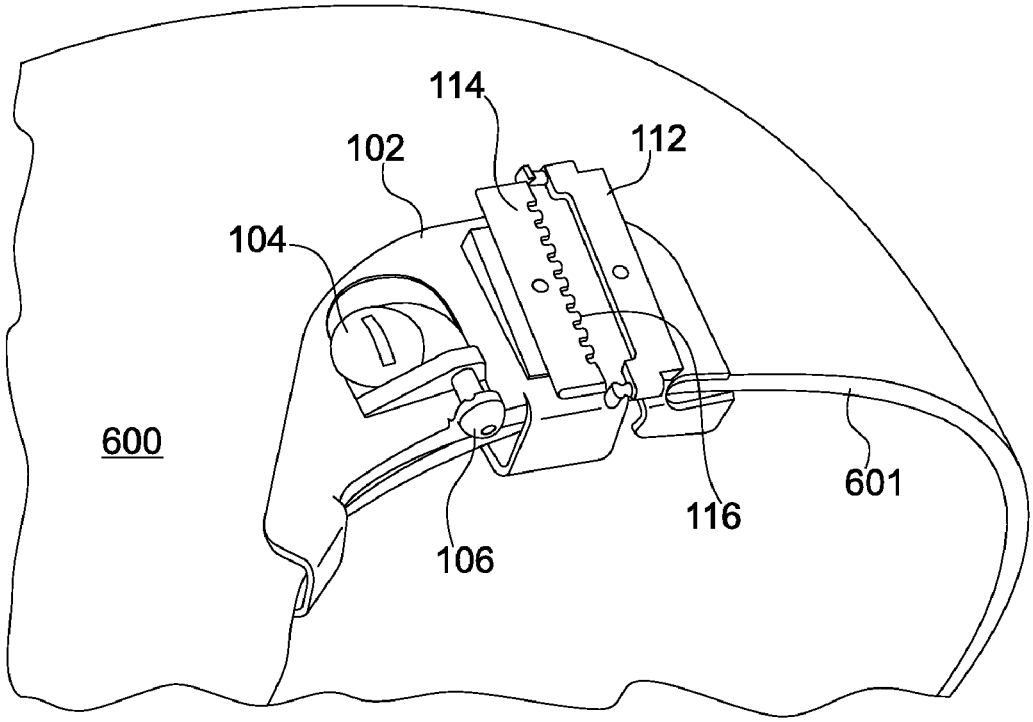
FIG. 5 is another perspective view of components of the device mount of FIG. 3, shown attached to a helmet body which is truncated for clarity.

Device mounts in accordance with the invention can be attached to helmets, harnesses or other types of articles worn on the head. Referring to FIG. 5, device mount 100 attaches to a lower rim 601 of helmet body 600 by a clamping bracket 102. Bracket 102 is secured to helmet 600 by a mounting screw 104 fastened in a screw hole extending through the side of the helmet. An adjustment screw 106 provides a side load to mounting screw 104 to stabilize the mounting screw against any potential movement caused by clearance in the screw hole.

Figure 3:
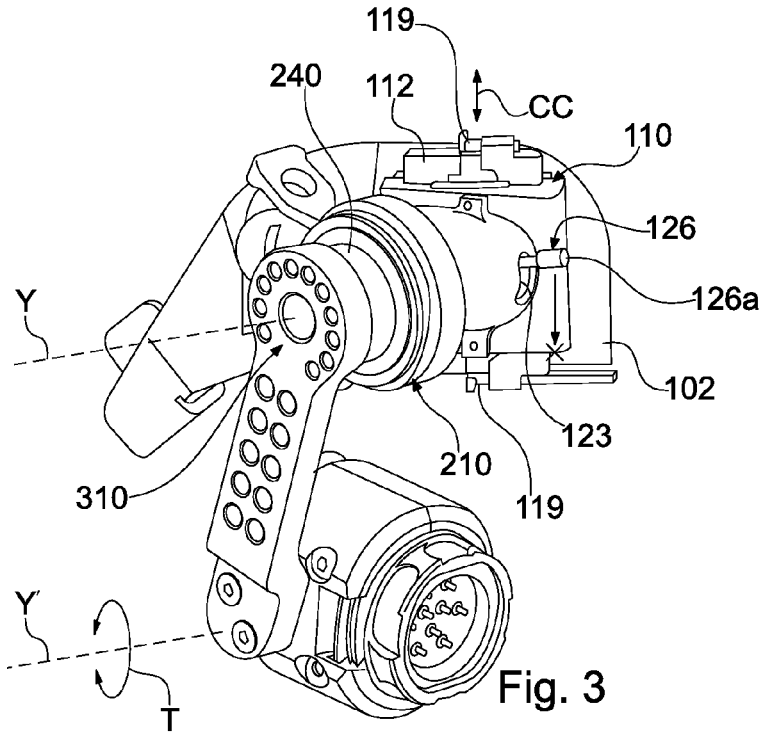
FIG. 3 is an enlarged perspective view of a device mount in accordance with one exemplary embodiment of the invention.
Figure 4:
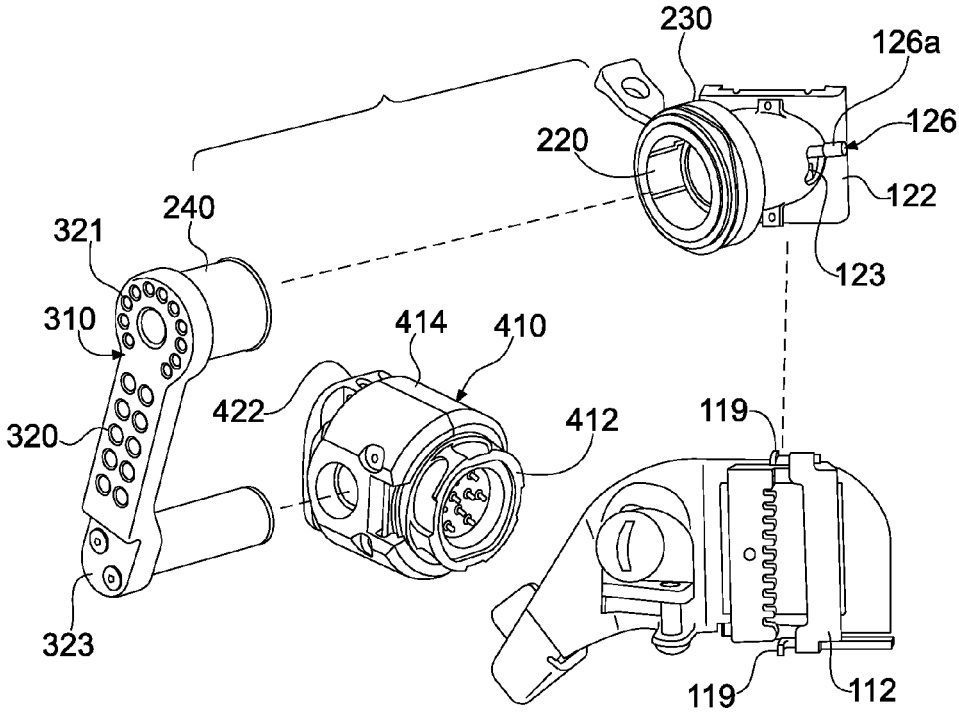
FIG. 4 is an exploded perspective view of components of the device mount of FIG. 3.

Referring to FIGS. 3-6, bracket 102 supports a first adjustment mechanism 110. First adjustment mechanism 110 can be operated by a user to adjust the position of a vision enhancement device in the cranial-caudal direction, i.e. up or down with respect to the user's viewpoint. A rail 112 projects from bracket 102 to form one part of first adjustment mechanism 110. Rail 112 has a trapezoidal or dovetail-shaped cross section. A slide member 122 has a channel 124 with a trapezoidal or dovetail-shaped cross section that corresponds and mates with the trapezoidal or dovetail-shaped cross-section of rail 112. Rail 112 includes a rack 114 having a series of teeth 116. Slide member 122 has a locking member 126, a lever portion **126*a* of which is shown in FIGS. 3 and 4. Lever portion 126*a* extends through a side slot 123 in slide member 122. Locking member 126 is biased into engagement with rack 114 by an internal spring inside channel 124. This locks the position of slide member 122 relative to rail 112. Locking member 126 can be released or disengaged from rack 114 by movement of lever portion 126*a*. More specifically, lever portion 126*a* can be moved downwardly in the direction shown by arrow X in FIG. 3 to disengage locking member 126 from teeth 116 in rack 114. Once locking member 126 is disengaged, the slide member 122 can be moved along the rail 112 to adjust the position of a mounted device along a cranial-caudal axis of movement. Rail 112 includes a pair of spring-loaded stop pins 119 to limit movement of slide member 122. If desired, slide member 122 can be removed from rail 112 by pressing in one of the stop pins 119** on the rail, which allows the slide member to be moved off of the end of the rail. This provides an easy way to remove the device mount and any attached equipment from the helmet in one step.

Figure 6:
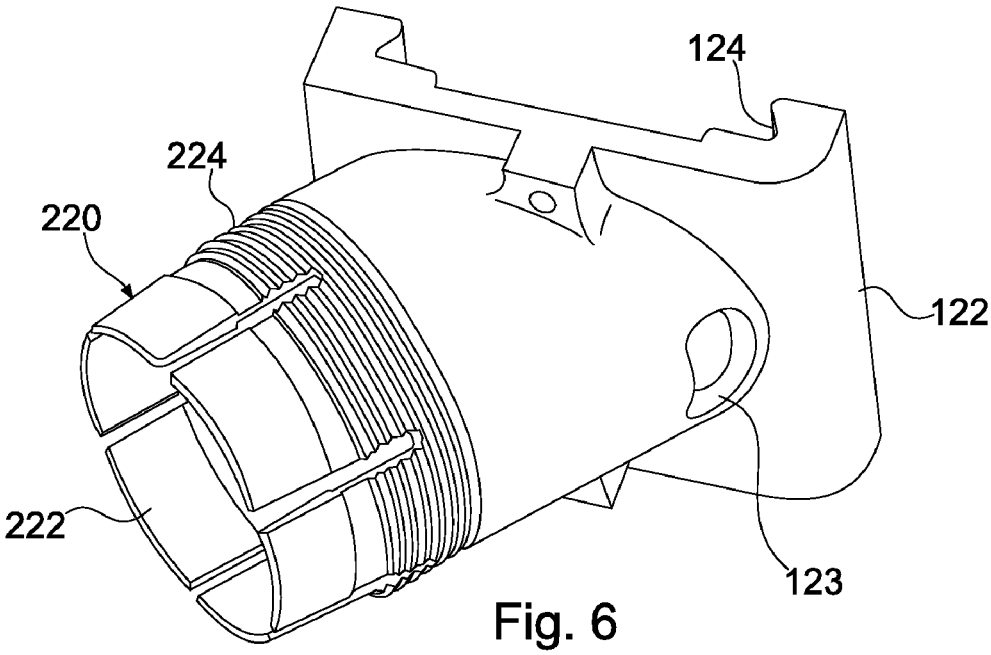
FIG. 6 is another perspective view of components of the device mount of FIG. 3.

Device mount 100 includes a second adjustment mechanism 210 that can be operated to adjust the position of a device along a medial-lateral axis of movement with respect to the user. Second adjustment mechanism 210 includes a tubular collet 220 that extends from slide member 122, as shown in FIGS. 4 and 6. Collet 220 includes a slotted portion 222 and an external thread 224. A collet nut 230 is screwed onto thread 224 and surrounds collet 220. Collet 220 surrounds a cylindrical shaft 240 in a telescoping arrangement. The inner diameter of the slotted portion 222 at the end of collet 220 is larger than the diameter of shaft 240. As a result, shaft 240 is axially displaceable through collet 220 along a medial-lateral adjustment axis Y, as shown in FIG. 3.

Collet nut 230 can be twisted or turned to move the nut between a locked position and an unlocked position. In the locked position, collet nut 230 is positioned toward the free end of collet 220 to radially compress the end of the collet. This clamps the end of collet 220 around shaft 240 in a tight locking arrangement that prevents the shaft from moving relative to the collet. In the unlocked position, collet nut 230 is positioned away from the end of collet 220, exerting less compressive force on slotted end 222 and allowing shaft 240 to slide along the medial-lateral axis relative to the collet.

Figure 7A:
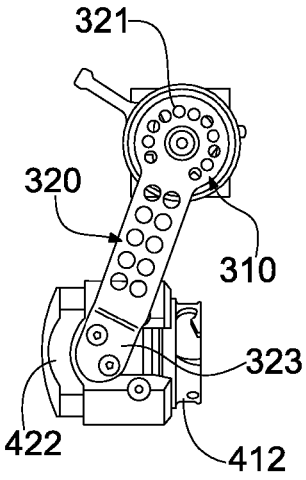
FIG. 7A is a side elevation view of components of the device mount of FIG. 3, showing the components positioned in a first arrangement.
Figure 7B:
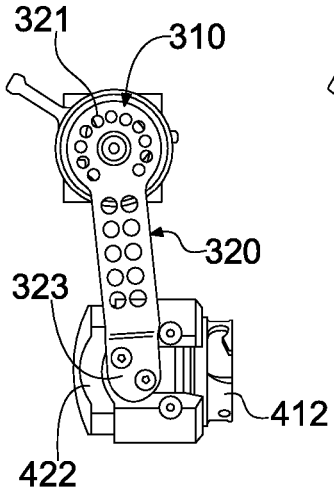
FIG. 7B is a side elevation view of components of the device mount of FIG. 3, showing the components positioned in a second arrangement.
Figure 7C:
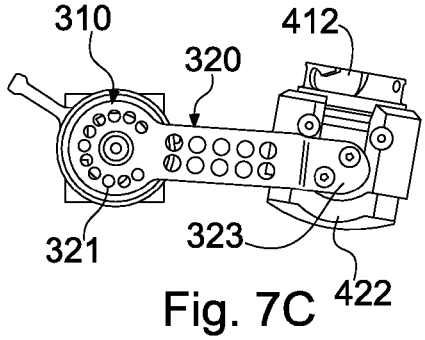
FIG. 7C is a side elevation view of components of the device mount of FIG. 3, showing the components positioned in a third arrangement.
Figure 8:
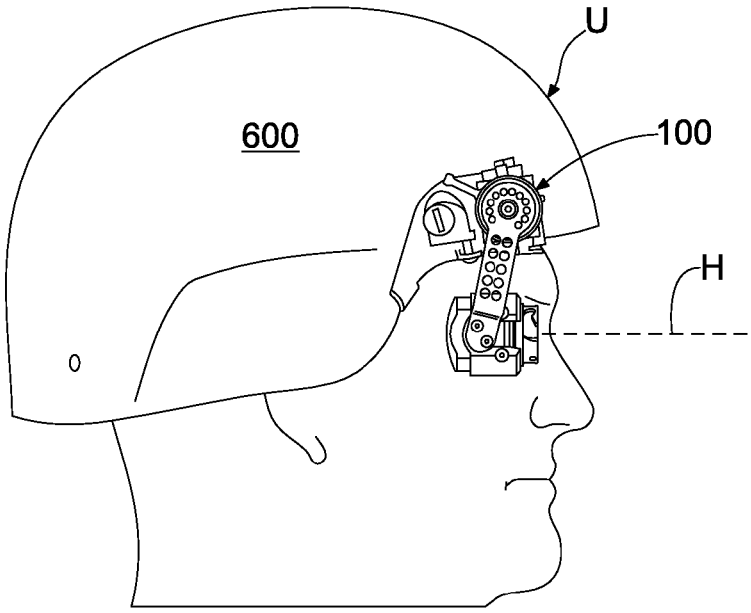
FIG. 8 is a side view of the device mount of FIG. 3 schematically shown in a first position of adjustment with respect to a user.
Figure 10:
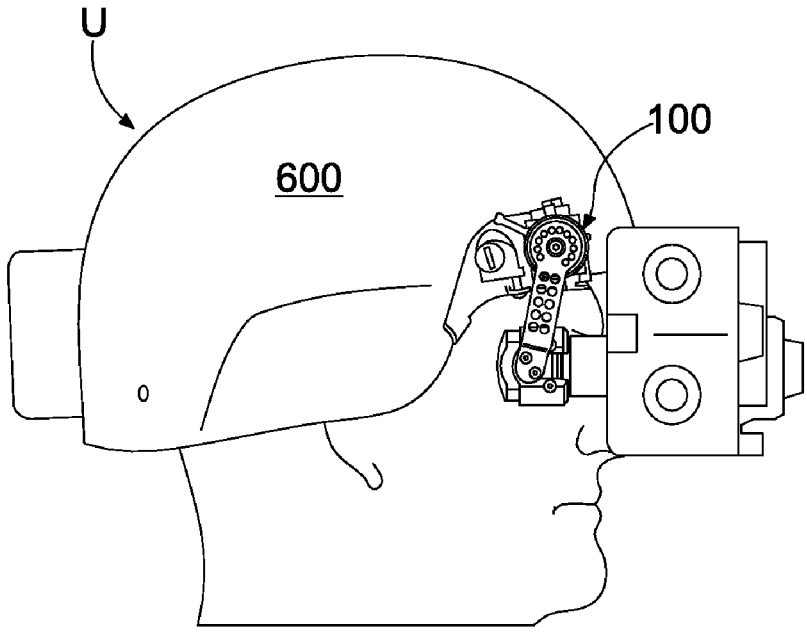
FIG. 10 is a side view of the device mount of FIG. 3 schematically shown with vision enhancement equipment in a first position of adjustment.
Figure 11:
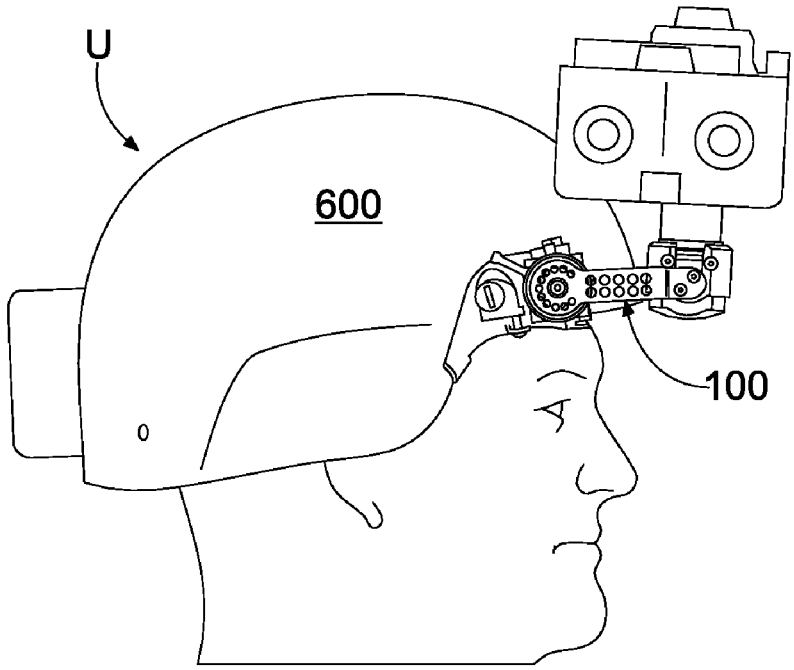
FIG. 11 is a side view of the device mount of FIG. 3 schematically shown with vision enhancement equipment in a second position of adjustment.

A third adjustment mechanism 310 extends from shaft 240, and includes an extension arm 320 having a first end 321 and a second end 323. First end 321 of extension arm 320 is coupled to an end of shaft 240. Third adjustment mechanism 310 allows the vision enhancement device to be rotated about medial-lateral adjustment axis Y through an angle greater than 90°. This provides a degree of freedom that allows the mounted vision enhancement device to be lowered down in front of the eye, or alternatively raised up into a stowed position when the device is not in use. Rotational adjustment also allows the device to be moved to an intermediate position between the lowered position and raised position. For example, the device may be moved to an intermediate position to allow additional clearance or "eye-relief" between the device and the user's eye so as to accommodate goggles or other gear worn over the eyes. FIG. 7A illustrates third adjustment mechanism 310 in a position that places a vision enhancement device in a normal operating position. This position, which is further illustrated relative to the user U in FIGS. 8 and 10, places the vision enhancement device's viewing element directly in front of the user's eye. In this position, the second end 323 is rotated posteriorly with respect to first end 321. FIG. 7B illustrates the third adjustment mechanism in an intermediate position between the lowered position and raised position. FIG. 7C illustrates third adjustment mechanism 310 in a position that places the vision enhancement device in a raised or stowed position. This position is further illustrated relative to the user U in FIG. 11. In this position, second end 323 is rotated anteriorly with respect to first end 321.

Figure 13:
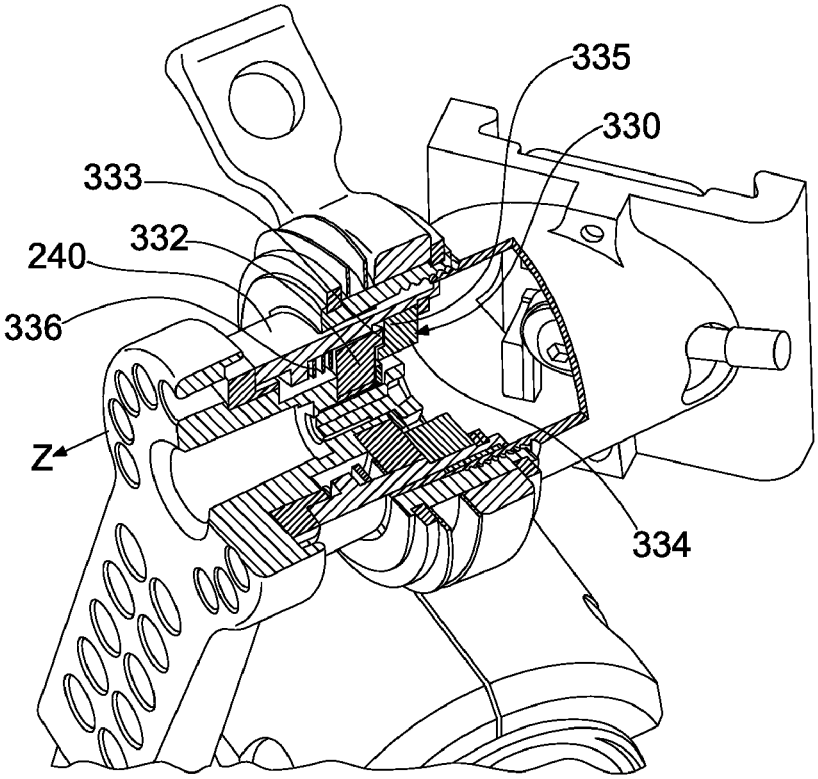
FIG. 13 is a partial truncated perspective view of the device mount of FIG. 3, with a portion broken away and removed to show internal components.

Third adjustment mechanism preferably includes a locking mechanism to lock extension arm 320 in different positions relative to its pivot axis, i.e. the medial-lateral adjustment axis Y. Referring to FIG. 13, a detent mechanism 330 is housed inside shaft 240. Detent mechanism 330 includes a first wheel 332 coupled to an end of extension arm, and a second wheel 334. First wheel 332 includes a plurality of projections 333, one of which is shown. Second wheel 334 includes a plurality of notches 335. Projections 333 are configured to mate and engage with notches 335. When projections 333 are engaged with notches 335, first and second wheels 332, 334 are locked together, fixing the orientation of extension arm 320. A spring element 336 biases the first wheel into engagement with the second wheel to fix the orientation of the extension arm under normal conditions. First wheel 332 can be temporarily separated or disengaged from second wheel 334 by pulling extension arm outwardly and away from second adjustment assembly 210, against the biasing force of spring element 336, in the direction labeled Z. Once the first and second wheels 332, 334 are separated, extension arm 320 is unlocked, allowing it to be rotated to move the vision enhancement device to a desired position. First and second wheels 332 and 334 may be designed with projections and notches in selected positions to facilitate locking in a limited number of positions. For example, detent mechanism 330 may provide projections and notches that lock extension arm 320 in only three positions, such as the normal, intermediate and raised positions shown in FIGS. 7A-7C. Alternatively, detent mechanism 330 may provide projections and notches that lock extension arm 320 in more than three positions.

Figure 9:
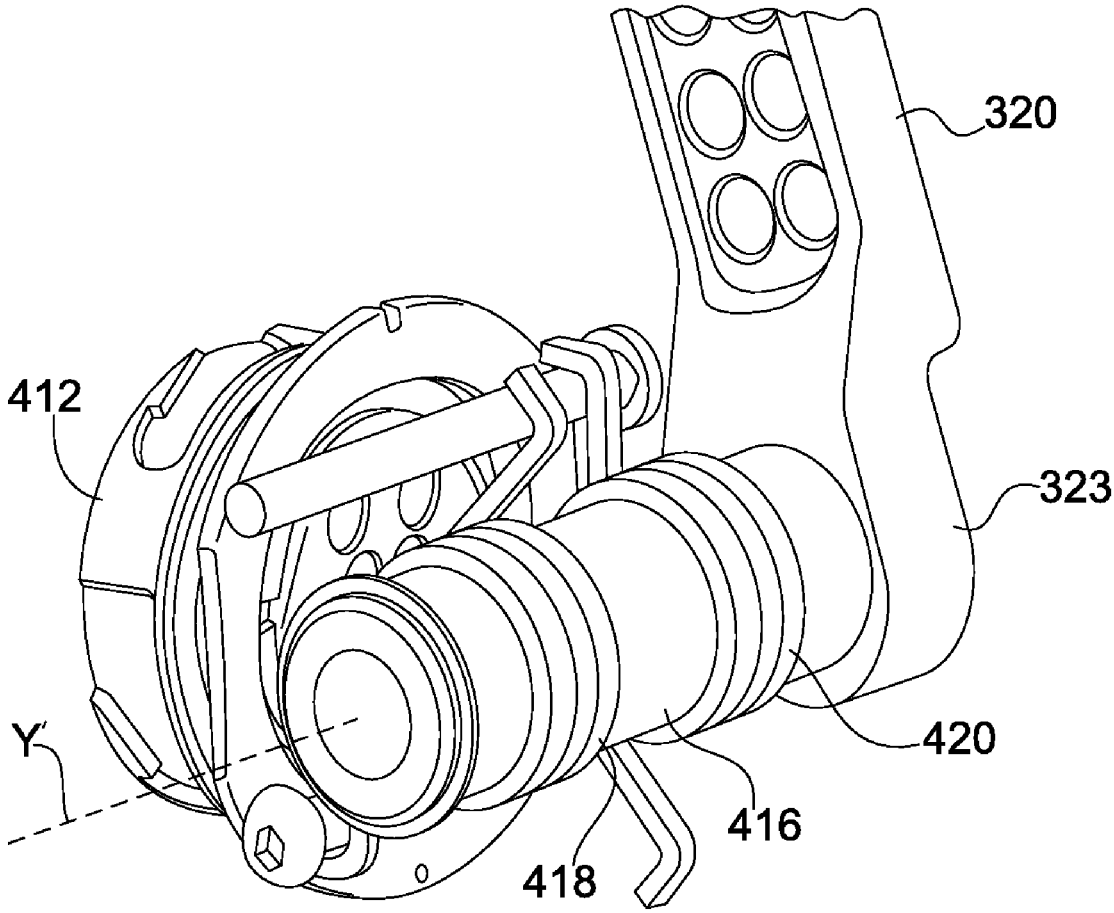
FIG. 9 is a another perspective view of components of the device mount of FIG. 3, with certain components truncated or omitted for clarity.
Figure 12:
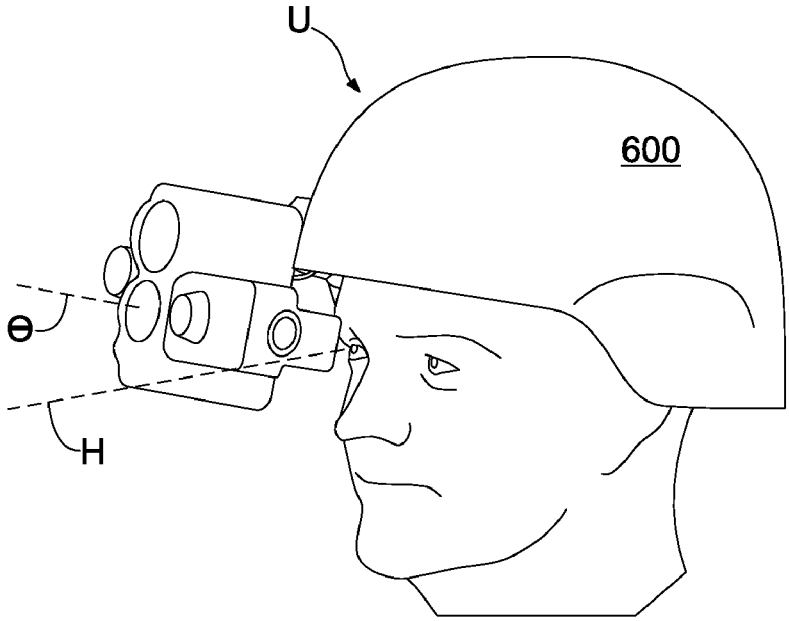
FIG. 12 is a perspective view schematically showing a vision enhancement device on a device mount and in a tilted orientation in accordance with the present invention.

Referring to FIGS. 4 and 9, a fourth adjustment mechanism 410 extends from second end 323 of extension arm 320. Fourth adjustment mechanism 410 is operable to tilt a vision enhancement device with respect to the user's eye, and change the user's line of sight with respect to horizontal, without moving the vision enhancement device away from the eye. FIG. 12 illustrates a vision enhancement device that is tilted upwardly at an acute angle Θ from a horizontal line H extending from a user's eye.

Fourth adjustment mechanism 410 includes a housing 414 and a connector 412 that connects device mount 100 to a vision enhancement device. To more clearly show the components of fourth adjustment mechanism 410, housing 414 is omitted from FIG. 9. Connector 412 and housing 414 are mounted on a tilt shaft 416. Tilt shaft 416 extends from second end 323 of extension arm 320 through housing 414, and defines a tilting axis Y' that is parallel to medial-lateral adjustment axis Y. In this arrangement, housing 414 is pivotably displaceable on tilt shaft 416 about tilting axis Y'. As housing 414 is tilted through an angle about tilting axis Y', vision enhancement device is tilted through the same angle. A locking mechanism in the form of a pair of wrap springs 418 and 420 fixes housing 414 in a preset orientation, so as to lock the line of sight through the vision enhancement device. Wrap springs 418 and 420 are wound in opposite directions and tightly engage tilt shaft 416 in frictional engagement, preventing housing 414 from tilting. The tension in wrap springs 418 and 420 can be released by pressing a tilt release button 422 on housing 414. When tilt release button 422 is pressed into housing 414, the button displaces a free end of each wrap spring and simultaneously unwinds the wrap spring by a small amount. This unwinding releases the grip of the wrap springs 418 and 420 on tilt shaft 416, so that housing 414 is free to tilt in a clockwise or counterclockwise direction about the tilt shaft. As housing 414 is tilted, wrap springs 418 and 420 pivot in response and assume a new orientation around tilt shaft 416. Once the desired position is achieved, the user releases the tilt release button 422, allowing wrap springs 418 and 420 to reestablish their grip on tilt shaft 416 and lock housing 414 in the new orientation.

In a preferred embodiment, tilt shaft 416 is positioned so as to align tilting axis Y' with interpupillary axis A. That is, tilt shaft 416 is positioned so that tilt axis Y' is coaxial with the interpupillary axis A, as shown by the same axes in FIG. 1. In this arrangement, the tilting motion of the vision enhancement device is conjugate with the up/down rotation of the eye in its socket. The exit pupil of the vision enhancement device, i.e. the point of the device adjacent to the user's eye, is not displaced from the user's line of sight during tilting. When the vision enhancement device is in use, the user can change their line of sight without moving the vision enhancement device away from the eye. Using one hand, the user grips housing 414, which is easily found adjacent the eye. The user then depresses the tilt release button 422 while maintaining their grip on housing 414. This unlocks housing 414, allowing the housing and vision enhancement device to be tilted. The housing 414 and vision enhancement device are then tilted to a desired angle, at which point the button 422 and housing are released. The vision enhancement device will be locked at the new angle. This is all done while the exit pupil of the vision enhancement device remains adjacent to the user's eye. That is, the vision enhancement device tilts or pivots about a point adjacent the user's eye, not some point in front of the eye. Thus, the tilting adjustment does not significantly displace the exit pupil of the vision enhancement device, if at all. Accordingly, the tilting of the device does not necessitate other vertical or horizontal adjustments to offset a change in position of the exit pupil. The user can continue looking through the vision enhancement device throughout the tilting maneuver.

Device mount 100 includes a number of articulating joints and connections. Unlike conventional mounting assemblies, device mount 100 is not prone to rattling or backlash caused by working clearances in the adjustment mechanisms. The first, third and fourth adjustment assemblies 110, 310 and 410 all incorporate springs or other biasing elements, as described above, to bias and retain the adjustment assemblies in locked positions. First adjustment assembly 110 includes an internal spring to bias the locking member 126 into engagement with the rack. Third adjustment assembly 310 includes a spring element 336 that biases the first and second wheels 332, 334 into engagement. Fourth adjustment assembly 410 includes wrap springs 418 and 420 that lock housing 420 in a preset orientation. Second adjustment assembly 210 is locked firmly in position by the threaded engagement. As a result, there is no accumulation of lost motion or backlash. The various assemblies and components within device mount 110 are maintained in a stable arrangement and fixed relationship that prevents rattling while the user's head is moving. Moreover, because the assemblies are either biased by spring mechanisms or firmly locked by threading, the assemblies are not susceptible to creep during vibration.

Device mounts in accordance with the invention generally, and the examples described above, provide a mounting option that is optimal for use by military personnel, law enforcement personnel and security personnel. In addition, device mounts in accordance with the invention have wide application for hunting, fishing, and any commercial or recreational activities where vision enhancement equipment are used.

While preferred embodiments of the invention have been shown and described herein, it will be understood that such embodiments are provided by way of example only. Numerous variations, changes and substitutions will occur to those skilled in the art without departing from the scope of the invention. Accordingly, it is intended that the appended claims cover all such variations as fall within the scope of the invention.

What is claimed:

1. A device mount for mounting a vision enhancement device to an article worn on a user's head, the device mount comprising:

a first adjustment member operable to move a mounted vision enhancement device in a cranial-caudal direction, the first adjustment member comprising a vertical rail having a rack, and a slide member that releasably engages the rack;

a second adjustment member extending from the first adjustment member and operable to move a mounted vision enhancement device along a medial-lateral adjustment axis; and a third adjustment member comprising an extension arm extending from the second adjustment member, the extension arm being rotatable with respect to the medial-lateral adjustment axis of the second adjustment member.

2. The device mount of claim 1, wherein the second adjustment member comprises a collet and a collet nut that is rotationally displaceable around the collet between an unlocked position and a locked position.

3. The device mount of claim 2, wherein the third adjustment member comprises a shaft that is axially displaceable through the collet along the medial-lateral adjustment axis.

4. The device mount of claim 3, wherein the shaft is displaceable through the collet along the medial-lateral adjustment axis when the collet nut is in the unlocked position, and fixed with respect to the medial-lateral adjustment axis when the collet nut is in the locked position.

5. The device mount of claim 1, wherein the extension arm comprises a first end pivotally coupled to the second adjustment member, and a second end coupled to a connector for connecting to a vision enhancement device, the extension arm being rotatable about the medial-lateral adjustment axis.

6. The device mount of claim 5, wherein the extension arm releasably engages the second adjustment assembly in a number of different locked positions, the extension arm being lockable in a normal position in which the second end is rotated posteriorly with respect to the first end, and a stowed position in which the second end is rotated anteriorly with respect to the first end.

7. The device mount of claim 6, wherein the extension arm releasably engages the second adjustment member in an intermediate position in which the second end is rotated to a position between the normal position and the stowed position.

8. The device mount of claim 5 comprising a fourth adjustment member pivotably coupled with the second end of the extension arm, the fourth adjustment member operable to tilt the connector about a pivot axis that is parallel to the medial-lateral adjustment axis.

9. The device mount of claim 8, wherein the fourth adjustment member includes a pivot lock operable in a locked condition to fix the orientation of the connector, and a released condition to permit the connector to pivot with respect to the pivot axis, the pivot lock being biased in the locked condition.

10. A helmet apparatus comprising:

a helmet body having an anterior end, a posterior end and an anterior-posterior axis;

a vision enhancement device extending from the helmet body;

a device mount supporting the vision enhancement device, the device mount being attached to the anterior end of the helmet body in a position offset from the anterior-posterior axis of the helmet body, the device mount comprising:

a first adjustment member operable to move a mounted vision enhancement device in a cranial-caudal direction with respect to the user, the first adjustment member comprising a vertical rail having a rack, and a slide member that releasably engages the rack;

a second adjustment member extending from the first adjustment member and operable to move a mounted vision enhancement device along a medial-lateral adjustment axis with respect to the user; and a third adjustment member comprising an extension arm extending from the second adjustment member, the extension arm being rotatable with respect to the medial-lateral adjustment axis of the second adjustment member; and a power supply attached to the posterior end of the helmet body in a position offset from the anterior-posterior axis of the helmet body in a position generally opposite the device mount.

11. The helmet apparatus of claim 10, wherein the second adjustment member comprises a collet and a collet nut that is rotationally displaceable around the collet between an unlocked position and a locked position.

12. The helmet apparatus of claim 11, wherein the third adjustment member comprises a shaft that is axially displaceable through the collet along the medial-lateral adjustment axis.

13. The helmet apparatus of claim 12, wherein the shaft is displaceable through the collet along the medial-lateral adjustment axis when the collet nut is in the unlocked position, and fixed with respect to the medial-lateral adjustment axis when the collet nut is in the locked position.

14. The helmet apparatus of claim 10, wherein the extension arm comprises a first end pivotally coupled to the second adjustment member, and a second end coupled to a connector for connecting to a vision enhancement device, the extension arm being rotatable about the medial-lateral adjustment axis.

15. The device mount of claim 14, wherein the extension arm releasably engages the second adjustment assembly in a number of different locked positions, the extension arm being lockable in a normal position in which the second end is rotated posteriorly with respect to the first end, and a stowed position in which the second end is rotated anteriorly with respect to the first end.

16. The device mount of claim 15, wherein the extension arm releasably engages the second adjustment member in an intermediate position in which the second end is rotated to a position between the normal position and the stowed position.

17. The helmet apparatus of claim 14 comprising a fourth adjustment member pivotably coupled with the second end of the extension arm, the fourth adjustment member operable to tilt the connector about a pivot axis that is parallel to the medial-lateral adjustment axis.

* * * * *